US005736494A

United States Patent [19]

Colurciello et al.

[11] Patent Number: 5,736,494

[45] Date of Patent: Apr. 7, 1998

[54] FLOWABLE NON-BORAX CONTAINING POWDER CARPET CLEANING COMPOSITIONS CONTAINING ANIONIC AND NONIONIC SURFACTANTS

[75] Inventors: Andrew F. Colurciello, Newburgh, N.Y.; Jeanne M. Weller, Glen Rock, N.J.

[73] Assignee: Reckitt & Colman Inc., Montvale, N.J.

[21] Appl. No.: 781,033

[22] Filed: Jan. 7, 1997

[30] Foreign Application Priority Data

Jan. 11, 1996 [GB] United Kingdom ..... 9600547

[51] Int. Cl.[6] ..... C11D 7/12; C11D 17/06; C11D 3/382

[52] U.S. Cl. ..... 510/278; 8/137; 8/142; 510/281; 510/473

[58] Field of Search ..... 510/278, 281, 510/473; 8/137, 142

[56] References Cited

U.S. PATENT DOCUMENTS

| | | | |
|---|---|---|---|
| 4,304,675 | 12/1981 | Corey et al. | 8/137.5 |
| 4,493,781 | 1/1985 | Chapman et al. | 8/137 |
| 4,552,777 | 11/1985 | Dente et al. | 427/393.1 |
| 4,566,980 | 1/1986 | Smith | 510/278 |
| 4,581,385 | 4/1986 | Smith et al. | 521/111 |
| 4,648,882 | 3/1987 | Osberghaus et al. | 8/142 |
| 4,659,494 | 4/1987 | Soldanski et al. | 8/142 |
| 4,834,900 | 5/1989 | Soldanski et al. | 8/142 |
| 5,286,400 | 2/1994 | Paszek et al. | 8/142 |
| 5,338,475 | 8/1994 | Corey et al. | 8/137 |
| 5,370,919 | 12/1994 | Fieuws et al. | 428/96 |
| 5,439,610 | 8/1995 | Ryan et al. | 8/137 |

OTHER PUBLICATIONS

Chemical Abstract No. 105:155114 which is an abstract of Japanese Patent Specification No. 61–130400 (Jun. 1986).

Chemical Abstract No. 123:344288 which is an abstract of German Patent Specification No. 4,411,047 (Oct. 1995).

*Primary Examiner*—Anthony Green

*Attorney, Agent, or Firm*—Fish & Richardson P.C.

[57] ABSTRACT

Flowable granular carpet cleaning compositions which do not contain borax or boric acid salts and which are readily shaken or strewn onto a carpet needing cleaning is disclosed. The compositions comprise as essential constituents: comminuted cellulose, zeolite, a inorganic salt system comprising of an (a) alkali metal carbonate, (b) an alkali metal bicarbonate, and an (c) alkali metal sesquicarbonate wherein the weight ratios of (a):(b):(c) are 1:0.5–2.5:0.5–2.5, one or more organic solvents, an organic or inorganic acid, anionic surfactant, nonionic surfactant and, water.

22 Claims, No Drawings

FLOWABLE NON-BORAX CONTAINING POWDER CARPET CLEANING COMPOSITIONS CONTAINING ANIONIC AND NONIONIC SURFACTANTS

The present invention relates to flowable powder carpet cleaning compositions. More particularly the present invention relates to flowable powder carpet cleaning compositions which do not contain borax or boric acid, and which are particularly useful in high traffic areas.

BACKGROUND OF THE INVENTION

A variety of carpet cleaning compositions are presently commercially available, including those in liquid and powder forms. Many powder carpet cleaning compositions are based upon an absorbent constituent such as a wood powder, an absorbent zeolite, or a finely comminuted polymeric resin, mounts of a carrier salt, further in conjunction with one or more surfactants which aid in the cleaning process, as well as one or more organic solvents which also aid in cleaning, and frequently controlled amounts of water. Many powder carpet cleaning compositions incorporate borax as a constituent.

In use, these compositions are applied upon a carpet surface requiring cleaning by dispensing the composition upon the carpet space such as by strewing the composition onto the fibers of the carpet. This provides for the contact of the cleaning composition with the soiled carpet fibers. A more intimate contact is frequently obtained by manually agitating the composition and fibers such as by a brush or other means to ensure a more thorough distribution. Upon such contact between the composition and soiled fibers, it is presumed that the liquids in the composition, namely the surfactants, organic solvents, and in some small degree water are responsible for aiding in the disassociation of the soil particulates from the carpet fibers and transporting them to the absorbent material. In this manner the stains may be transferred to the absorbent material, and then the absorbent material is removed, typically after a significant portion of the liquids, particularly any organic solvents and water, evaporate. The absorbent material is then removed from the carpet fiber by a conventional means such as by brushing or vacuum cleaning.

Advantages of such a cleaning process include that it is particularly adapted to so called wall-to-wall carpet installations whether they be in a commercial or domestic environment as in such installation, the carpet cannot be removed. A further advantage of such a cleaning process is that it is readily performable by consumers. A third advantage of such a cleaning process is that if it is performed in a regular and conscientious schedule, such cleaning can contribute substantially to the maintenance of the long term attractive appearance of such an installed carpet, which favorably extends the useful life of the carpet.

In order for a powdered carpet cleaning composition to be successful from both the technical as well as the commercial standpoint, it is generally required that the composition provide good cleaning efficacy, and also that it be attractive in view of its physical characteristics to a consumer. By means of attractive it is to be understood that optical appearance i.e., a bright and whitish color is generally preferred over those which may be yellowish or grayish in appearance. A further aspect is in the visual appearance of such a product. It is found that consumers frequently find powdered cleaning compositions which have a noticeable yellow cast or color tinge to them, as well as those which have a gray color cast or tinge to be undesired as they appear to be already soiled within the dispenser container or as they are dispensed upon the carpet surface. Powders which are substantially white or tend to be whitish in color are noticeably brighter, appear to be cleaner, and are generally much more widely preferred by consumers.

Further, such a composition should be readily dispersible. Certain compositions may be effective cleaners and thus be technically successful, however would fail if they are either too dry and powdery in form so that they tend to form powdery billows in the air and resist the deposition upon the carpet surface. Such a dusty atmosphere is very undesirable especially to the consumer applying such composition. In the opposite extreme, powdered carpet cleaning compositions which are too wet and agglomerate too easily may be considered at the least unattractive by a consumer, but more importantly where the carpet cleaner may be too wet and/or agglomerated, then the cleaning composition may appear to resist uniform distribution when shaken or strewn from a container onto the surface of the carpet. Such an undesirably wet composition is also to be desirably avoided as requiring a longer drying time and/or evaporation time after deposition of such a composition and prior to its withdrawal such as by brushing or vacuum cleaning.

Importantly, such powder carpet cleaning compositions, in order to be successful in the marketplace need not only be technically successful in their cleaning function, but also need to be available at a low cost.

Various compositions for carpet cleaning particularly for powdered carpet cleaning preparations are known to the art, each not without its attendant benefits as well as shortcomings. These include compositions described in one or more of the following patents.

U.S. Pat. No. 4,493,781 to Chapman, as well as U.S. Pat. No. 4,648,882 to Osberghaus et al., describe certain powdered carpet cleaning compositions comprising a significant proportion of one or more zeolite constituents.

U.S. Pat. No. 4,552,777 to Dente et al., describes certain powdered carpet cleaning compositions comprising 40–98.94% wt. of in inorganic salt carrier selected from sulfates, chlorides, carbonates, bicarbonates, borates, citrates, phosphates, nitrates and blends thereof, 1.0–25% wt. of an agglomerating agent, 0.01–18% wt. of a volatile organic material, and minor amounts of a polysiloxane constituent.

U.S. Pat. No. 4,581,385 to Smith et al., discloses a strewable carpet cleaning composition which includes as an active cleaning constituent shreds of a hydrophilic polyurethane foam having entrained in their surface an abrasive material.

U.S. Pat. No. 5,370,919 to Fiewes et al., describes processes for providing stain repellency to carpets by treating the carpet fibers with an aqueous composition which includes a water soluble or water dispersible radical containing poly(oxyalkylene) compound.

U.S. Pat. No. 5,439,610 to Ryan et at., discloses specific aqueous carpet cleaning compositions which include a sodium lauryl sulfate as a surfactant, ethylene glycol monohexyl ether as a solvent constituent, as well as fluorinated surfactants and a styrene-maleic-anhydride constituent.

U.S. Pat. No. 5,338,475 to Corey et al., discloses certain aqueous carpet cleaning compositions which include mounts of hydrogen peroxide as a bleaching/carpet brightener constituent.

U.S. Pat. No. 5,286,400 to Paszek et al. provides certain flowable, powdered carpet cleaning formulations which include powdered cellulose adsorbents, borax, and a zeolite and/or hydrated amorphous silica constituent with the proviso that one or the latter need be present.

U.S. Pat. No. 4,304,675 to Corey discusses specific non free-flowing carpet compositions which include 50–90% wt. of an inorganic salt constituent which is used as a carrier.

U.S. Pat. No. 4,566,980 to Smith discloses certain carpet cleaning compositions which are of granular appearance which are based on inorganic salt particles which are provided with a latex, film forming coating on their surface.

U.S. Pat. No. 4,659,494 to Soldanski discloses certain zeolite bee, powdered carpet cleaning compositions comprising an adsorbent constituent, an organic solvent constituent and a significant proportion of water.

A further patent to Soldanski, U.S. Pat. No. 4,834,900 discloses a two-step process for cleaning carpets which includes a first step of applying a liquid, paste or collapsible foam type cleaning composition to the locus of a stain, wherein such cleaning composition comprises in excess of about 70% wt. of one or more volatile solvents. The second step of applying a powder composition to the total surface of the carpet being dleaned prior to the drying of the first composition. The powder composition of the second step appears to be substantially the same as that disclosed in U.S. Pat. No. 4,659,494.

Published application WO 94/07980 disclosed aqueous compositions useful as fabric cleaners which include specific amounts of a fabric cleaning polymer, a wax having a melting point in excess of 50° C., and a silicone betaine polymer constituent.

In view of the foregoing then, it is apparent that the production of a successful carpet cleaning composition of the powdered type is not a simple exercise in mixing of known constituents, nor one which is simply performed in order to properly address and satisfy the myriad parameters and to provide an appropriate balance of both technical i.e. cleaning affect as well as consumer appeal i.e. appearance and attribute.

In view of the foregoing, is it should be apparent that there exists a real and present need in the art for improved carpet cleaning compositions, particularly for readily strewable, attractive powder carpet cleaning compositions which are good cleaners, and which may be easily applied to a carpet in need of a cleaning treatment and which is readily removable by conventional means, such as by the use of a vacuum cleaning device.

Thus it is among the objects of the invention to provide improved powdered carpet cleaning compositions which satisfy the technical requirements of effective cleaning while at the same time satisfying the requirements of the consumer, particularly in appearance of the product composition and its ready application to a carpet surface requiring cleaning.

It is a further object of the invention to provide an improved process for the cleaning of a carpet surface requiring such a treatment which may be performed by the application for sufficient time and sufficient amount of the novel carpet cleaners being described herein.

These and other objects of the present invention are satisfied by the powdered carpet cleaning compositions which are described in more detail below.

SUMMARY OF THE INVENTION AND DETAILED DESCRIPTION

In accordance with a present invention there is provided a flowable powder carpet cleaning composition which does not contain borax or boric acid and which comprise the following constituents:

A) 25–40% by weight cellulose absorbent,

B) 0–7% by weight Zeolite or amorphous silica,

C) 12–20% by weight inorganic salt system comprising of
   (a) alkali metal carbonate,
   (b) an alkali metal bicarbonate, and (c) an alkali metal sesquicarbonate wherein the ratios of (a):(b):(c) are 1:0.5–2.5:0.5–2.5;

D) 0.1–10% by weight organic solvent,

E) 0–5% by weight acid,

F) 0.01–3% by weight anionic surfactant,

G) 0.01–5% by weight nonionic surfactant the remaining weight % balance to 100% by weight of water, and further, I) optionally up to about 10% by weight of one or more known art, optional constituents. The compositions do not contain borax or boric acid, and are at an alkaline pH, but are desirably at a pH of at least 8.0.

In accordance with a further aspect of the present invention there is provided an improved process for cleaning carpets in need of such a cleaning treatment which comprises the steps of: strewing or otherwise distributing an effective amount of the carpet cleaning composition described above, permitting the composition to remain interspersed with the carpet fibers for a sufficient interval of time to permit the loosening of soils from the carpet fibers and absorption by the cleaning composition, and subsequently withdrawing the carpet cleaning composition from the carpet fibers, preferably by vacuuming.

The powder carpet cleaning composition includes a comminuted cellulose constituent. This comminuted cellulose constituent acts both as a carrier for other constituents, as well as an adsorbent material for entraining released soils or stains from the carpet surface. Such cellulose constituents include a variety of materials which are known and readily commercially available, including cellulose powders. Examples of such cellulose constituents include those described, for instance, in U.S. Pat. No. 5,286,400 as well as in U.S. Pat. No. 4,659,494, the contents of which are herein incorporated by reference. Such cellulose powders are typically obtained from naturally occurring sources, i.e. vegetables sources and most particularly from wood. The wood is generally comminuted by a conventional size reduction process which may be chemical and/or mechanical in nature and the recovered powders are generally dry, free flowing and substantially colorless, and which may be provided in a wide range of particle sizes from as small as about 1 micron to several millimeters in size. Particle size may be determined by a wide variety of known methods including passing the particulates through a standardized sieve and reference to particle sizes are to be understood to refer to the average diameter of such particles. While the particle size may vary widely, it is preferred however that the cellulose powders according to the invention have an average diameter within the range of about 10 microns to about 250 microns and more preferably from about 10 microns to about 100 microns. The size selection ensures the average particle sizes used in the cellulose constituent are not overly fine and thus be undesirably amenable to be dusty and often undesirably air-borne, while at the same time that the comminuted cellulose particles be of sizes which are not undesirably large so as to resist intimate interspersion with the carpet fibers, particularly the soiled carpet fibers being treated by the present inventive compositions.

The cellulose powders may be derived from any source including without distinction hard woods and/or soft woods.

As it is well known, these materials not only differ in their physical characteristics i.e. as lumber, but also typically have different constituencies of cellulases, hemicellulase, and xylanase and lignin in their makeup. In accordance with the present invention while the cellulose powders may be derived from hardwoods or softwoods of a low lignin content, or even more desirably the lignin be substantially removed from the cellulose powders. It has been observed by the present inventors that the presence of undesirable amounts of lignin imparts an undesirable yellowish color cast to the final powdered cleaning composition. Such a yellowish color cast or color tinge is undesirable particularly from a consumer standpoint due to the appearance of such a cleaning composition as already soiled prior to its use. It is believed that the lignin reacts with any carbonate constituents present in the composition and such reaction causes the undesired coloring.

Desirably the comminuted cellulose constituent is included to comprise between about 25 and 40% by weight of the carpet cleaning composition. More desirably, the weight percent cellulase is present in amount of about 25–35% by weight, based on the total weight of the composition.

The compositions include finely divided crystalline zeolites, and/or amorphous silica. Any natural or synthetic zeolites or mixtures thereof may be used, and the compositions of the invention may include zeolites to the exclusion of the amorphous silica, or amorphous silica to the exclusion of zeolites, mixtures of or amorphous silica and zeolites, or neither amorphous silica nor zeolites.

Preferred crystalline zeolites and/or amorphous silicas are generally available as dry free flowing powders made up of finely divided particles which exhibit the capacity to absorb liquid systems and regulate the rheological properties of the powdered carpet cleaning compositions being taught herein. Some of these materials generally may include up to about 25% by weight of water which cannot be removed further without the application of extreme dehydration condition. As it does, further recitation parts by weight of such zeolite constituents or silica constituents presume to include this proportion of water unless otherwise indicated.

The amorphous silica is a hydrated amorphous silica, and may also be a synthetic precipitated silica. Such materials are known, and are commercially available such as Hi-Sil® from PPG Co. (Pittsburgh PA).

Useful zeolites include those may be of the hydroxysodalite type as well as those of the so called type "A", type "P", type "X", type "Y" and type "Z" zeolites. These zeolites may have a variety of associated exchangeable cations present within; preferably however the exchangeable cations present in the zeolites are sodium ions. Such useful zeolites include those described in U.S. Pat. No. 4,304,675 the contents which are herein incorporated by reference.

Preferred zeolites which may be included in the compositions of the invention include those which are chemical oxides according to the formula:

$$Na_2O\ Al_2O_3xSiO_2yH_2O$$

wherein the value of "x" is 2, and the value of "y"/"x" is about 1–5. Such compositions include forms of zeolites which are commonly referred to as types "X", "Y", "Z" and type "A" zeolites. Typically type "X" zeolites have the general formula $Na_2O\ Al_2O_3\ 2.5SiO_26H_2O$. Type "Y" zeolites typically conform to the general formula $Na_2O\ Al_2O_32SiO_2\ 4.5H_2O$. Type "A" zeolites typically conform to the formula $Na_2O\ Al_2O_32SiO_2\ 4.5H_2O$. Other useful zeolites which may be used in the present inventive compositions are known to the art, such as those described in U.S. Pat. No. 4,648,882, U.S. Pat. No. 4,493,781, U.S. Pat. No. 5,286,400 the contents of which are herein incorporated by reference.

The preferred sodium aluminum silicates useful as zeolites are available from a variety of commercial sources, including example zeolites Na-A from the PQ Corporation and also commercially known as VALFOR-100 OR, as well as a zeolite presently commercially available as ZB-100 from the Union Carbide Corporation (Danbury CT).

The present inventors have found that while it is known to the art that zeolites are effective absorbents thus making them favorably considered for use in such powdered compositions, at the same time they are also known to be unusually strong in their adhesion to fiber and thus resist their removal by conventional means such as by vacuum cleaning or brushing. This is an effect which is particularly noticeable with darker shades of carpet fibers as in the presence of these adherent zeolite particles these darker carpet fibers may be undesirably discolored. Thus, in the past zeolites have not been fully successfully incorporated in powdered cleaning compositions without such undesired side effects occuring. Surprisingly, the present inventors have found that the controlled amounts of zeolites provide not only the known desire of effective cleaning which is attended upon the use of such compositions but more importantly, the controlled limited amounts of zeolites in the present compositions in conjunction with the other essential constituents, particularly the amounts of the alkali carbonate, alkali bicarbonate and alkali sesquicarbonate making up the powder carpet clearing compositions according to the present invention, have been found to be readily and substantially removable from carpet fibers. In this way, the benefits of the presence of zeolites in a powdered carpet cleaning compositions are provided with the attendant benefits of excellent cleaning, while at the same overcoming the problem(s) which have been long associated with the use of zeolites and compositions i.e., that of undesired darkening of the carpet fibers.

While a zeolite constituent may be omitted, desirably the zeolite and/or hydrated amorphous silica constituent is present to comprise at least about 0.001% by weight and may be included to comprise up to about 7% by weight of the carpet cleaning composition. More desirably, the zeolite and/or hydrated amorphous silica constituent, if present, is present in amount of about 1–4% parts by weight.

The compositions of the invention also comprise a inorganic salt system which consists essentially of an (a) alkali metal carbonate, (b) an alkali metal bicarbonate, and (c) an alkali metal sesquicarbonate wherein the weight percentage ratios of (a):(b):(c) is 1:0.5–2.5:0.5–2.5. More desirably the weight ratios of (a):(b):(c) is 1:1–1.5:1–1.5, and still more desirably the ratios of (a):(b):(c) is 1:1–1.2: 1–1.2. Most desirably in any of the above noted ratios of (a):co):(c) amount of the alkali metal bicarbonate is equal to or is desirably in excess of the amount of the alkali metal carbonate, such that (a)≦(b). It is also desired that the amount of the alkali metal sesquicarbonate is equal to or is deskably in excess of the amount of the alkali metal carbonate, such that (a)≦(c). It is also very desirable that the amount of alkali metal bicarbonate and the alkali metal sesquicarbonate in the compositions are equal, so that (b)=(c). It is most preferred that (a)≦(b) and (a) ≦(c) and at the same time that (b)≦(c). In such a manner, it is assured that the amount of the alkali metal sesquicarbonate and the amount of the alkali metal bicarbonate are each present in equal amounts, but desirably in excess of the alkali metal carbonate present. Preferably the alkali metal is a sodium. The alkali metal carbonate, an alkali metal bicarbonate, and alkali metal sesquicarbonate are all inorganic salts which, per se, are known to the art, and which are commercially available from a variety of sources.

The present inventors have surprisingly observed that the presence of the inorganic salt system comprising the sodium carbonate, sodium bicarbonate and sodium sesquicarbonate within the specific limited proportions and in the specific limited ratios relative to each other contributes to the overall effective cleaning provided by the inventive compositions. This specific inorganic salt system on the one hand has been observed to limit the undesired effects of dusting, and on the other hand limit the undesired agglomeration and clumping upon a carpet surface as well. This is particularly surprising as the present inventors have observed that use of only a carbonate absent the bicarbonate and the sesquicarbonate provides good cleaning effect and yet boosts the pH to an unacceptably high levels and thus detracts from the overall operation of the powdered carpet cleaning compositions. Further, the present inventors have found that the use of only a bicarbonate, while providing good absorbency is undeskably fine and pulverent and excessive dusting has been observed to frequently result. At the same time, the use of only a sesquicarbonate having a needle like structure provides good absorbency, but has also been observed to detract from the overall cleaning characteristics of the carpet cleaning compositions being taught herein. The present inventors have found that the selection of these three materials within these proportions and in the specific ratios both with respect to one another and as an overall amount relative to the total powdered cleaning composition provides the synergistic benefit of excellent cleaning, good absorbency, while eliminating or substantially reducing the undesired pH ranges in the final product. This is surprising as it has been further observed that no one, nor two of these materials overcome these prejudices and technical shortcomings but it is required that all three be present and within the relative ranges respective to one another in order to provide the benefits of the invention.

Desirably the inorganic salt system comprising the sodium carbonate, sodium bicarbonate and sodium sesquicarbonate described above is included to comprise between about 12 and 20% by weight of the carpet cleaning composition. More desirably, the total amount of these salts are present in amount of about 12–16% by weight.

Organic solvents in the present inventive compositions inclined many which are known to the art and these can be water-miscible or water immiscible solvents. As will be appreciated by the skilled practitioner, the selection of these organic solvents may in no small part be dictated by the types of stains which are to be solubilized from the soiled carpet fibers, as well as the fact that the selected organic solvents should not adversely affect textiles or fibers, particularly carpet fibers, At the same time, the organic solvents must be sufficiently volatile to evaporate in a reasonable time, generally in no more than about 45 minutes after application to these textiles or fibers. Farther, these organic solvents should have a high enough flash point to avoid danger of fire and further, and they should be toxicologically acceptable.

Exemplary organic solvents useful in the present invention are include alcohols and ketones, particularly those comprising 8 or less carbon atoms. Further especially useful organic solvents are glycol ethers having the general structure $R_1$—O—$R_b$—OH, wherein $P_a$ is an alkoxy of 1 to 20 carbon atoms, or aryloxy of at least 6 carbon atoms, and $R_b$ is an ether condensate of propylene glycol and/or ethylene glycol having from one to ten glycol monomer units. Of particular mention are glycol ethers having one to five glycol monomer units; these are $C_3$–$C_{20}$ glycol ethers. Examples of more preferred solvents include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. More preferably employed as the solvent is one or more of the group consisting of ethylene glycol n-butyl ether, diethylene glycol n-butyl ether, and mixtures thereof. Most preferably, the solvent is a glycol ether in the DOWANOL™ glycol ether series available from The Dow Chemical Company (Midland Mich), or as one of the CARBITOL™ series from Union Carbide (Danbury Conn.).

The use of one or more glycol ethers is preferred as these materials are known to be useful in the solubilization of a variety of clifferent stains, such as oil-based stains and water-based stains, as well as having an elevated flash point which reduces the likelihood of ignition or combustion of the composition.

These organic solvents are all known and are readily commercially available from various sources, and may be used individually or as mixtures of two or more. Desirably the organic solvent system is included to comprise between about 0.1–10 % by weight of the carpet cleaning composition. More desirably, the organic solvent is present in amount of about 5–7% by weight.

The compositions of the invention further optionally but desirably include an acid constituent in an amount effective to adjust the pH of the final carpet cleaning composition within a desired pH range. This acid constituent may be a single acid or a mixture of acids. The acid may be an organic acid, or an inorganic acid, or as recited may be one or more of both inorganic and organic acids. Contemplated as useful are known inorganic and organic acids, which may be used in their free acid forms, or in salt forms as well. Inorganic acids include dilute mineral acids acids such as hydrochloric and sulfuric acids, and organic acids include organic compounds comprising one or more carboxylic acidic groups as well as salts thereof. Preferred for use in the present inventive compositions are organic acids. By way of non-limiting example, these include citric acid as well as ethyelene diaminete traacetic acid, both of which are readily commercially available are to be mentioned as being especially preferred as these materials are effective in the compositions of the invention. As noted, this acid constituent is desirably included in amounts effective to adjust the pH range of the compositions to a desired, level and are typically present in an amount of up to about 5% by weight, and desirably is present in an amount of from about 0.01–3% by weight.

The compositions according to the invention are preferably alkaline in character, exhibiting a pH of at least about 8.0, but desirably exhibit a pH in the range of about 8.0–10.0, even more desirably have a pH in the range of 9.0–9.75, and most desirably exhibit a pH of about 9.25–9.50. This alkaline nature of the compositions is distinct from many prior art compositions.

The compositions of the invention further include an anionic surfactant constituent which may be a single surfactant, or may be a mixture of surfactants. As the anionic surfactant constituent, a wide variety of known anionic surfactants are suitable. The list includes those of the sulfate or sulfonate type, although other types can also be employed, such as soaps, long-chain N-acylsarcosinates, salts of fatty acid cyanamides or salts of ether carboxylic acids, of the type obtainable from long-chain alkyl or alkylphenyl polyglycol ethers and chloracetic acid. The aniohic surfactants may be used in the form of the alkali metal or alkali earth metal salts, most preferably as sodium salts.

Particularly suitable surfactants of the sulfate type are the sulfuric acid monoesters of long-chain primary alcohols of natural and synthetic origin containing from 10 to 20 carbon atoms, i.e. fatty alcohols, such as, for example, coconut oil fatty alcohols, tallow fatty alcohols, oleyl alcohol, or $C_{10}$–$C_{20}$-oxo-alcohols and those of secondary alcohols having the same chain lengths. Other suitable surfactants of the sulfate type are sulfuric acid monoesters of aliphatic primary alcohols, secondary alcohols or alkylphenols ethoxylated with from 1 to 6 moles of ethylene oxide. Sulfated fatty acid alkanolamides and sulfated fatty acid monoglycefides are also suitable.

Surfactants of the sulfonate type are, primarily, sulfosucciuic acid mono- and diesters containing 6–22 carbon atoms in the alcohol portion, alkylbenzene sulfonates containing $C_9$–$C_{15}$ alkyl groups and esters of sulfofatty acids, for example, the sulfonated methyl or ethyl ester of hydrogenated coconut oil, palm kernel oil or tallow fatty acids. Other suitable surfactants of the sulfonate type are the alkane sulfonates obtainable from $C_{12}$–$C_{20}$ alkanes by sulfochlorination or sulfoxidation, followed by hydrolysis or neutralization, or by the addition of bisulfites onto olefins, and also olefm sulfonates, i.e. mixtures of alkene and hydroxyalkane sulfonates and disulfonates of the type obtained, for example, from long-chain monoolefins containing a terminal or internal double bond by sulfonation with gaseous sulfur trioxide, followed by alkaline or acidic hydrolysis of the sulfonation products. $C_{12}$–$C_{20}$ fatty alcohol sulfates, the salts of sulfosuccinic acid monoesters containing from 16 to 20 carbon atoms in the alcohol portion and mixtures of these surfactants are particularly preferred.

Further useful anionic surfactants which may form part of the inventive compositions include compounds which are based on alkyl sulfosuccinates, alkyl ether sulfosuccinates, alkylamide sulfosuccinates, as well as alkyl sulfosuccinamates. A particularly useful and preferred anionic surfactant material which is presently commercially available material is one under the trade name Rhodaterge® (Rhone-Poulenc Co., Cranbury N.J.), particularly Rhodaterge® RS-25 which is described as aqueous preparation which contains in its active constituent part a blend of approx. 86% wt. sodium lauryl sulfate and 14% wt. sodium sulfosuccinate.

Particularly useful anionic surfactants include lauryl sulfate which has been observed to volatilize and dry, leaving a powdery residue, such as particularly Rhodaterge® RS-25, as well as other anionic surfactant materials based on sulfosuccinates.

Desirably the anionic surfactant constituent is included to comprise between about 0.01 and 3% by weight of the carpet cleaning composition. More desirably, the anionic surfactant constituent is present in amount of about 0.01–1.5% parts by weight.

The compositions of the invention further include a minor amount of a nonionic surfactant constituent. A wide variety of known nonionic surfactants may be used, including the polyoxyethylene ethers of alkyl aromatic hydroxy compounds, e.g., alkylated polyoxyethylene phenols, polyoxyethylene ethers of long chain aliphatic alcohols, as well as the polyoxyethylene ethers of hydrophobic propylene oxide polymers.

In particular, useful as the nonionic surfactant constituent are the condensation products of a higher alcohol (e.g., an alkanol containing about 8 to 18 carbon atoms in a straight or branched chain configuration) condensed with about 5 to 30 moles of ethylene oxide, for example, lauryl or myristyl alcohol condensed with about 16 moles of ethylene oxide (EO), tridecanol condensed with about 6 to moles of EO, myristyl alcohol condensed with about 10 moles of EO per mole ofmyristyl alcohol, the condensation product of EO with a cut of coconut fatty alcohol containing a mixture of fatty alcohols with alkyl chains varying from 10 to about 14 carbon atoms in length and wherein the condensate contains either about 6 moles EO per mole of total alcohol or about 9 moles of EO per mole of alcohol and tallow alcohol ethoxylates containing 6 EO to 11 EO per mole of alcohol.

A preferred group of the foregoing nonionic surfactants are the those presently marketed under the tradename "Neodol" (Shell Chemical Co., Houston Tex.), which are higher aliphatic, primary alcohol containing about 9–15 carbon atoms, such as $C_9$—$C_{11}$ alkanol condensed with 8 moles of ethylene oxide (Neodol® 91-8), $C_{11}$ alkanol condensed with 5 moles ethylene oxide (Neodol® 1–5), $C_{12-13}$ alkanol condensed with 5 moles ethylene oxide (Neodol® 23-5), $C_{12-13}$ alkanol condensed with 6.5 moles ethylene oxide Neodol® 23-6.5), $C_{12-15}$ alkanol condensed with 12 moles ethylene oxide (Neodol® 25-12), $C_{14-15}$ alkanol condensed with 13 moles ethylene oxide (Neodol® 45-13), and the like. Such ethoxamers exhibit good oil-in-water emulsification and good determine characteristics.

A further preferred group of the forgoing nonionic surfactants are those presently marketed under the tradename "PolyTergent" (Olin Chemical Co., Stamford Conn.), which are described as being alkoxylated alcohols containing about 9–15 carbon atoms. These include for example PolyTergent® SL-22, which is believed to be a $C_{8-10}$ alkoxylated alcohol with about 3 mols of ethoxylation/propoxylation and which has a cloud point of about 22° F., as well as PolyTergent® SL-62, which is also believed to be a $C_{8-10}$ alkoxylated alcohol with about 3 mols of ethoxylation/propoxylation and exhibiting a cloud point of about 62° F. These materials also exhibit good oil-in-water emulsification and also provide good determine characteristics. These materials have relatively high HLB values (greater than about 10).

Additional satisfactory water soluble alcohol ethylene oxide condensates are the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type are $C_{11}$–$C_{15}$ secondary alkanol condensed with either 9 EO (Tergitol® 15-S-9) or 12 EO (Tergitol® 15-S-12) marketed by Union Carbide (Danbury Conn.).

One further useful class of nonionic surfactants include ethoxylated octyl and nonyl phenols, and in particular those having one of the following general structural formulas:

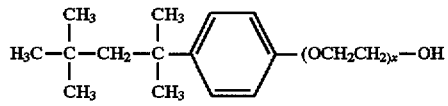

or,

-continued

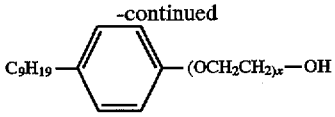

in which the $C_9H_{19}$ group in the latter formula is a mixture of branched chained isomers, and x indicates an average number of ethoxy traits in the side chain. Suitable non-ionic ethoxylated octyl and nonyl phenols include those having from about 7 to about 13 ethoxy units. Such compounds are commercially available under the trade name Triton® X, including Triton® X-100 (Union Carbide, Danbury Conn.).

The nonionic surfactant constituent may be a single, or may also be a mixture or blend of two or more nonionic surfactant compounds. The nonionic surfactant constituent is included in generally small mounts, usually from 0.01–5% wt. based on the total weight of the composition. Desirably smaller mounts are used, such as about 0.01–0.5% wt, and most desirably is present in an amount of from about 0.15–0.35% wt., and especially about 0.25% wt.

Water forms a further constituent according to the invention, and may be added to the constituents noted above in an amount to provide 100% by weight of the composition. Desirably, the water is included in amounts of from about 35% –55% by weight of the present inventive compositions, and still more desirably forms about 42% –48% by weight of the inventive compositions. As will be realized, the water is also useful as a solvent for water-based stains.

The water may be provided from a variety of sources, including tap water, but is preferably distilled and is most preferably deionized water. If the water is tap water, it is preferably substantially free of any undesirable impurities such as organics or inorganics, especially minerals salts which are present in hard water which may thus interfere with the operation of one or more of the essential constituents, as well as any other optional constituents of the powder cleaning compositions according to the invention.

The compositions according to the invention are moist to the touch, are not powdery or dusty in character and thus when shaken or strewn from a suitable dispensing container, such as a dispensing container with a perforated cap, readily disperse into small, non-powdery particles when dispensed. When applied to the surface of a carpet or other fibrous substrate, the composition does not tend to dust or drift from the fibrous substrate, but generally remains in rest on the top of the said substrate. The compositions of the invention typically exhibit a bulk density of from 0.30–0.45 grams per cubic centimeter of volume.

The compositions according to the invention may comprise one or more of the following optional constituents, the total weight of such optional constituents not exceeding about 10% of the total weight of the composition, more preferably not exceeding about 7% by weight, still more preferably not exceeding about 5% by weight and most preferably less than 5% by weight based on the total weight of the composition according to the invention. These optional constituents include but are not limited to: buffers and pH adjusting agents, fragrances and deodorizing agents, fillers and carriers including inorganic salts, optical brighteners and bleaching constituents, ultraviolet absorbants, antistatics, germicides, preservatives, fillers including talc and naturally occurring or synthetic clays, further scattering and spreading promoters, antisoiling or resoiling inhibitors, chelating agents as well as others known to the art but not elucidated here. Such constituents as described above include known art compositions, including those described in *McCutcheon's Detergents and Emulsifiers,* North American Edition, 1991; Kirk-Othmer, *Encyclopedia of Chemical Technology,* 3rd Ed., Vol. 22, pp. 346–387. Such optional constituents may be included in amounts which do not undesirably detract from the advantageous features provided by the essential constituents forming the inventive compositions.

In order to adjust the compositions of the invention to the desired pH ranges described herein, the use of known art acidic or alkaline buffering agents is recognized. Exemplary materials for this purpose include inorganic or organic acids and salts thereof, including citric acid, and aminopolycarboxylic acids and salts thereof, as well as ammonia.

Fragrances, whether naturally or synthetically produced may be-used in the inventive compositions. Such fragrances may be added in any conventional manner, admixing to a composition or blending with other constituents used to form a composition, in amounts which are found to be useful to enhance or impart the desired scent characteristic to the composition, and/or to cleaning compositions formed therefrom.

Useful fillers and carders include comminuted talc which is widely available in powder form, as well as clays, for example, smectite clays, montmorillonites, sodium saponites, and sodium hectorites. Inorganic salts which are useful as carriers include alkali and alkaline earth metals salts ofsulfates, chlorides, carbonates and bicarbonates other than sodium carbonate, sodium bicarbonate, citrates, phosphates, nitrates as well as blends thereof. These materials, per se, are known to the art.

Useful antisoiling or resoiling inhibitors include for example, colloidal silica, aluminum oxides, styrene-maleic anhydride copolymer resins, polyvinylpyrrolidone, polyacrylates, vinyl acetate/maleic anhydride copolymer resins, cationic amines, aliphatic quarternary ammonium salts known to have anti-static properties, imidazoline salts, as well as certain fluorochemicals which may introduce or restore stain repellency, but which may also inhibit resoiling. Preferred are aluminum oxides which are known to impart both anti-static and anti-soiling properties to treated carpet fibers, as well as contributing as an anti-caking agent to the inventive compositions.

Useful as optical brighteners are known optical brightening agents, including those based on stilbene derivatives and distyrylbiphenyl derivatives. Bleaching agents known to the art, including hydrogen peroxide may be used in the inventive compositions.

Useful as chelating agents include those known to the art, including aminopolycarboxylic acids and salts thereof wherein the amino nitrogen has attached thereto two or more substituent groups. Preferred chelating agents include acids and salts, expecially the sodium and potassium salts of ethylenediaminertetraacetic acid, diethylenetriaminepentaacetic acid, N-hydroxyethylethylenediaminetriacefic acid, and of which the sodium salts of ethylenediaminetetraacetic acid may be particularly advantageously used.

Exemplary useful preservatives include those based on parabene, including methyl parabens and ethyl parabens, as well as commercially available materials such as KATHON™ CG-ICP available from Rohm and Haas (Philadelphia Pa.).

The present inventors have surprisingly found that through the use of the specific constituents described above, within the proportions recited above, that there is provided an excellent powdered carpet cleaning composition which exhibits good flowability, an alkaline pH which is particularly suited for the removal of many common stains, an excellent bulk density which is not so low as to render the composition too powdery and difficult to dispense in measured amounts into dispensing containers or to make it too dusty when applied, nor too high so to make the product carpet cleaning composition to heavy and difficult to uniformly strew from a dispensing container, excellent stain removal, is readily vacuumed, as well as other characteristics noted elsewhere within this specification.

In accordance with particularly preferred embodiments of the present invention there are provide a flowable powder carpet cleaning compositions which consist essentially of the following constituents:

A) 25–35% by weight cellulose absorbent,

B) 1–4% by weight zeolite and/or amorphous silica,

C) 12–16% by weight inorganic salt system comprising of (a) alkali metal carbonate, (b) an alkali metal bicarbonate, and (c) an alkali metal sesquicarbonate wherein the ratios of (a):(b):(c) are 1:1–1.2:1–1.2;

D) 5–7% by weight organic solvent,

E) 0.01–3% by weight

F) 0.5–1.5% by weight anionic surfactant, g) 0.15–0.35% by weight nonionic surfactant, H) 42–48.5% by weight water, and optionally I) up to 10% by weight of one or more known art, optional constituents. The compositions do not contain borax or boric acid, and are at a pH in the range of 9–10 and are generally at a pH of about 9.5. The compositions of the invention desirably exhibit a bulk density of from 0.30–0.45 grams per cubic centimeter of volume.

The production of the compositions is technically straightforward.. Mostly single-stage processes can be used, well known mixers, such as paddle mixers, drum mixers, augers mixers and the like. Typically the finely divided solid constituents are initially introduced into the mixer in which they are then sprayed while mixing with the liquid constituents. Alternately, either the solid constituents and/or the liquid constituents are premixed prior to their introduction into the mixer. It is preferred however that a low shear mixing apparatus be used throughout the mixing process. After thorough blending of the finely divided solid constituents with the liquid constituents a smooth flowable powder is produced.

In accordance with the cleaning process according to the invention, fibrous textiles and especially carpets are cleaned by scattering the cleaning formulations according to the invention onto the textiles in the locus of the soiled area either by hand or by means of a suitable appliance and then rubbing them more or less intensively so to intersperse the composition into the textile fibers, for example,, by means of a sponge or brush, such as a short bristled brush. In general, the rubbing-in times are between 0.5 to 2.5 minutes and preferably between 0.5 and 1.5 minutes per square meter. After the formulations have been rubbed in, the textiles are left to dry until the formulations which combine with the dirt have changed into dry residues. These residues are then removed from the textile mechanically, for example, by brushing out or by vacuum cleaning. For the surface cleaning of textile, the formulations of the invention are used in quantities of from 20 to 200 g/m$^2$, depending on the fullness of the textiles and their degree of soiling, although they can also be locally applied in larger quantities for removing individual stains. For the surface cleaning of carpets, the formulations of the invention are normally used in quantities of from 25 to 150 g/m$^2$. The process as a whole can be carried out largely by hand, for example, in the home, although it is also possible to carry out the rubbing-in step and, optionally other steps by means of suitable appliances, for example, combined scattering and brushing machines, so that the process is equally suitable for use on an industrial scale.

While the compositions have been described as useful in conjunction with the cleaning of carpets and fibers, the compositions may find use with other substrates as well. Substrates which can be treated in accordance with this invention are textile fibers or filaments, either prior to their use, or as used in fabricated fibrous articles such as fabrics and textiles, rugs, carpets, mats, screens, and the like. The textiles include those made of one or more natural fibers, such as cotton and wool, regenerated natural fibers including regenerated cellulose, and those made of synthetic organic fibers, such as polyamides, polyolefins, polyvinylidene chlorides, acetate, polyacrylics, rayon, and polyester fibers. Blends of two or more such fibrous materials are also expressly contemplated.

The carpet cleaning compositions according to the invention have also been surprisingly been found to exhibit remarkable shelf stability, and resistance to discoloration. Very frequently as is known in many prior art compositions, such compositions tend to discolor and/or undesirably agglomerate or cake when exposed to long periods of shelf life especially at to high temperatures, viz., in excess of about 37.7° C. (100° F.). Such conditions are not unheard of, and are frequently found during the warehousing and distribution of such compositions, particularly during the summer season. Such characteristics are undesirable due to the fact that they detract from favorable dispersion of the cleaning compositions as they are dispensed from their dispensing container, and/or evident discoloration is objectionable to a consumer. Such degradation has been observed in known prior art compositions over even short periods of time, generally even as short as several weeks.

Surprisingly, and most beneficially the present compositions being taught herein advantageously exhibit little change over extended time intervals, even upon exposure to elevated temperatures. As such, it should then be apparent that the present compositions overcome an important technical deficiency to many prior art carpet cleaning compositions.

The following examples illustrate the superior properties of the formulations of the invention. The terms "parts by weight" or "percentage weight" are used interchangeably in the specification and in the following Examples wherein the weight percentages of each oft he individual constituents are indicated in weight percent based on the total weight of the composition, unless indicated otherwise.

EXAMPLES

Each of the formulations described in Tables 1 and 2 were made by preblending weighed amounts of the individual dry components used in their respective formulations until a homogeneous dry blend was produced, after which the liquid constituents were slowly added to form their final compositions.

With respect to the individual constituents used to make up these compositions, the comminuted cellulose constituent was a low lignin or substantially lignin free cellulose powder derived from either hardwood or softwood cellulose sources. Various sources and blends were evaluated. The zeolite constituent was either VALFOR-100 OR, or ZB-100 as described above. The remaining constituents were all readily commercially available from a variety of sources.

TABLE 1

| Constituents: | Comp. 1 | Comp. 2 | Comp. 3 | Comp. 4 | Comp. 5 | Comp. 6 | Comp. 7 | Comp. 8 | Comp. 9 |
|---|---|---|---|---|---|---|---|---|---|
| comminuted cellulose | 30.00 | 30.00 | 30.00 | 30.00 | 30.00 | 27.00 | 28.00 | 25.00 | 30.00 |
| sodium aluminosilicate zeolite | 5.00 | 5.00 | 5.00 | 5.00 | 5.00 | 3.00 | 3.00 | 2.40 | 2.40 |
| sodium sesquicarbonate | — | 15.00 | — | — | — | 17.00 | 15.00 | 6.00 | 8.60 |
| sodium bicarbonate | — | — | 15.00 | 10.00 | 5.00 | — | — | 8.50 | 6.00 |
| sodium carbonate | — | — | — | 5.00 | 10.00 | 3.00 | 4.00 | 4.00 | 3.00 |
| citric acid, (anhydrous) | — | — | — | — | — | | — | 1.60 | — |
| 3-methoxy-3-methyl-1-butanol | 3.15 | 3.15 | 3.15 | 3.15 | 3.15 | 3.15 | 3.15 | 3.15 | 3.15 |
| n-propoxypropanol | 3 15 | 3.15 | 3.15 | 3.15 | 3.15 | 3.15 | 3.15 | 3.15 | 3.15 |
| lauryl sulfate | 0.65 | 0.65 | 0.65 | 0.65 | 0.65 | 0.65 | 0.65 | 0.65 | 0.65 |
| sodium succinate | 0.1 | 0.1 | 0.1 | 0.1 | 0.1 | 0.1 | 0.1 | 0.1 | 0.1 |
| fragrance | 0.10 | 0.10 | 0.10 | 0.10 | 0.10 | 0.10 | 0.10 | 0.10 | 0.10 |
| deionized water | 42.85 | 42.85 | 42.85 | 42.85 | 42.85 | 42.85 | 42.85 | 43.10 | 42.85 |
| borax | 15.00 | — | — | — | — | — | — | — | — |

TABLE 2

| Constituents: | Ex. 2-1 | Ex. 2-2 | Ex. 2-3 | Ex. 2-4 | Ex. 2-5 |
|---|---|---|---|---|---|
| comminuted cellulose | 30.00 | 30.00 | 30.00 | 30.00 | 30.00 |
| sodium aluminosilicate zeolite | 2.40 | 2.40 | 2.40 | 2.40 | 2.40 |
| sodium sesquicarbonate | 4.50 | 4.50 | 4.50 | 4.50 | 4.50 |
| sodium bicarbonate | 4.50 | 4.50 | 4.50 | 4.50 | 4.50 |
| sodium carbonate | 4.00 | 4.00 | 4.00 | 4.00 | 4.00 |
| citric acid, (anhydrous) | 1.60 | 1.60 | 1.60 | 1.60 | 1.60 |
| 3-methoxy-3-methyl-1-butanol | 3.15 | 3.15 | 3.15 | 3.15 | 3.15 |
| n-propoxypropanol | 3.15 | 3.15 | 3.15 | 3.15 | 3.15 |
| sodium lauryl sulfate | 0.65 | 0.65 | 0.65 | 0.65 | 0.65 |
| sodium sulfosuccinate | 0.10 | 0.10 | 0.10 | 0.10 | 0.10 |
| alkoxylated $C_{8-10}$ alcohol, approx. 3 moles ethoxylation[1] | 0.25 | — | — | — | — |
| alkoxylated $C_{8-10}$ alcohol; approx. 3 moles ethoxylation[2] | — | 0.25 | — | — | — |
| mixture of ethoxylated octyl phenols and ethoxylated nonyl phenols[3] | — | — | 0.25 | — | — |
| alkoxylated $C_{11}$ alcohols, approx. 5 moles ethoxylation[4] | — | — | — | 0.25 | — |
| alkoxylated $C_{12-13}$ alcohols, approx. 5 moles ethoxylation[5] | — | — | — | — | 0.25 |
| deionized water | 43.35 | 43.35 | 43.35 | 43.35 | 43.35 |
| borax | — | — | — | — | — |

[1]supplied as the actives constituent in PolyTergent ® SL-22
[2]supplied as the actives constituent in PolyTergent ® SL-62
[3]supplied as the actives constituent in Triton ® X-100
[4]supplied as the actives constituent in Neodol ® 1-5
[5]supplied as the actives constituent in Neodol ® 23-5

Subsequently, the formulations of Table 1 were evaluated as to their cleaning efficacy generally in accordance with AATCC Test Method 123–1989 which test provides an indication of the cleaning efficacy of carpet cleaning compositions against a standardized synthetic soil. This test demonstrates the critical relationship of the relative amounts of the alkali metal carbonate, alkali metal bi-carbonate, and alkali-metal sesquicarbonate systems described in the instant specification.

This test protocol used may be generally described as follows. A synthetic soil is prepared which is comprised of the following: dark peat moss, 30% by weight; portland cement, 17% by weight; kaolin clay, 17% by weight; silica (200 mesh) 17% by weight; lamp or furnace carbon black, 0.75% by weight; red iron oxide, 0.5% by weight; and medicinal grade mineral oil, 8.75% by weight. The synthetic soil was prepared by mixing all the dry ingredients gathered thoroughly to ensure the production of a homogenized dry mixture after which point the mineral oil was added. Afterwards the mixture was run in a ball mill for approximately 24 hours and the mixture is stored in vapor tight containers in-between uses.

Carpet swatches of 9 square foot sizes were prepared based on a commercially available DuPont™ nylon carpet samples of a very light beige color. Selection of this color provided a readily discernible visual appearance of the soiling level as well as the efficacy of the tested cleaning composition. In each of the tests, a uniform amount of soil, approximately equal to 0.5 grams of the standardized synthetic soil was applied per square foot of the carpet. Afterwards the synthetic soil was brushed in manually using vigorous scrubbing and a short bristle brush; this was done in order to thoroughly intersperse the synthetic soil with the carpet fibers down to the carpet's fiber backing. Subsequently, the surface soil remaining at the top surface of the carpet was quickly removed by sweeping said surface with a vacuum .so that nonentrained soils were readily removed. This also approximates a typical vacuuming operation as might be performed in a domestic household.

After the preparation of the soiled carpet sample, a test amount of approximately 20–30 grams of compositions described in Tables 1 was applied per square foot of the soiled carpet fiber, after which the particular composition was brushed in again using a short bristle brush. Such a manual brushing operation ensures that the composition being tested was interspersed between the carpet fibers down to the carpet backing, and contacts the synthetic soil. The carpet swatch was then allowed to dry for approximately 45 minutes at which point the carpet was observed only slightly moist or dry to the touch. Subsequently, each of the carpet samples was vacuumed using several light strokes in order to remove the cleaning composition. This again approximated a typical vacuuming operation as might be performed in a domestic household. Afterwards the samples were visually observed and compared.

The formulations according to comparative example 2, comparative example 3, comparative example 4, comparative example 5, comparative example 6, and comparative example 7, demonstrate formulations are noted to lack one or more of the alkali salts recited as among the necessary constituents according to the invention as well as further lacking an effective amount of the acid constituent, and of the nonionic surfactant. Each of these compositions, following the carpet soiling and test as described above, was determined to be poorer cleaning than the comparative example 1 formulation. The formulations demonstrated in comparative example 8 and comparative example 9 demonstrated compositions which include the alkali metal carbonate, alkali metal bi-carbonate, and alkali-metal sesquicarbonate systems, but which, however, are in proportions which fall outside of the ranges described in the invention. Comparative example 8 included an amount of an acid constituent while comparative example 9 omitted the acid constituent. Both of these formulations were also determined to be poorer cleaning than the compositions according to comparative example 1.

The compositions described on Table 2, demonstrate formulations which fall within the scope of the present invention. The cleaning characteristics, an performance of these formulations was evaluated in accordance with the following tests.

Samples of each of the formulations according to Ex. 2-1, 2-2, 2-3, 2-4 and 2-5 were evaluated for efficacy in a "hallway test", a test designed to be particularly representative of the actual in-use environment for the formulations. In this test, a carpet swatch of a Philadelphia Hall of Fame band, 100% DuPont certified Nylon carpet, of a light color described as "Sugar Cane" measuring 7 feet by 3 feet was used. This carpet swatch was divided into seven contiguous zones, the first Zone 1 beginning at one end and being 3 feet in width and 1 feet in length. Zone 2 being contiguous to the prior zone 1 and being 3 feet in width and extended for 1 foot in length. The next contiguous zone, Zone 3, 3 feet in width and extending 1 foot in length. The next contiguous zone, Zone 4, contiguous to the prior Zone 3, was 3 feet in width and 1 foot in length. The next contiguous Zone 5, which was contiguous to the prior Zone 4, was 3 feet in width and 1 foot in length. The next Zone 6 was contiguous to the prior Zone 5, was 3 feet in width and 1 foot in length. The final Zone 7 was contiguous to the prior Zone 6, and consisted of the final 3 feet in width and 1 foot in length of the test carpet swatch. This test carpet swatch was treated in accordance with the following protocol: Zone 1 and Zone 7 were left untreated and are designated "control (untreated)", and were used for comparative purposes. To each of Zones 2 through 6 were applied 75 grams of one of each of the formulations according to Examples 2-1, 2-2, 2-3, 2-4 and 2-5 described on Table 2. Thereafter, each of these zones of the carpet test swatch were rubbed into the carpet using a brush, and the carpet test swatch was then penetrated to dry overnight. The swatch was then vacuumed to remove any excess.

Thereafter the thus treated test carpet swatch was installed in a busy hallway, and taped down using a strong adhesive tape at its edges. The carpet was retained in this location for six weeks, and the normal passersby of the hallway were permitted to pass over the total surface of the thus installed test carpet swatch. It was estimated that approximately 24,000 individuals passed across the surface of the test carpet swatch during six week interval. Subsequently, the test carpet swatch was removed from the floor, vacuumed and qualitatively evaluated by the inventor. The performance of the formulations were each determined to be very good and comparable to known art commercially available powdered carpet cleaning products.

Samples of each of the formulations according to Ex. 2-1, 2-2, 2-3, 2-4 and 2-5 were evaluated for shelf stability wherein each of the samples was held at room temperature (approx. 68° F., 20° C.), and at the lower temperature of 40° F, as well as at the higher temperature of 105° F. for a period of 6 weeks. At the conclusion of the test, each of the formulations held at each of the three test temperatures was found to be satisfactory.

Similarly, samples of each of the formulations according to Ex. 2-1, 2-2, 2-3, 2-4 and 2-5 were evaluated for shelf stability in an accelerated aging text wherein each of the samples was held at 120° F. for a period of 4 weeks, which effectively simulates harsh storage conditions. Although there was observed a slight yellowing of the formulations, the odor, color and other characteristics of the compositions remained unchanged and the tested products were found to be satisfactory.

Samples of each of the formulations according to Ex. 2-1, 2-2, 2-3, 2-4 and 2-5 were evaluated for freeze/thaw stability. According to the text, the samples were subjected to three successive cycles of the test wherein in each cycle, a room temperature sample was frozen, then permitted to thaw to room temperature. At the conclusion of the three freeze/thaw cycles, each of the formulations held at each of the three test temperatures was found to be satisfactory.

While described in terms of the presently preferred embodiments, it is to be understood that the present disclosure is to be interpreted as by way of illustration, and not by way of limitation, and that various modifications and alterations apparent to one skilled in the art may be made without departing from the scope and spirit of the present invention.

We claim:

1. A powdered carpet cleaning composition comprising:

A) from 25 to 40% by weight of a cellulose absorbent;

B) from 0 to 7% by weight of a zeolite or amorphous silica;

C) from 12 to 20% by weight of an inorganic salt system comprising (a) an alkali metal carbonate; (b) an alkali metal bicarbonate; and (c) an alkali metal sesquicarbonate, wherein the weight percentage ratios of (a):(b):(c) are 1:0.5–2.5:0.5–2.5;

D) from 0.1 to 10% by weight of an organic solvent;

E) from 0 to 5% by weight of an acid;

F) from 0.01 to 3% by weight of an anionic surfactant;

G) from 0.01 to 5% by weight of a nonionic surfactant; and

H) the remaining weight % balance to 100% by weight of water, with the proviso that the compositions do not comprise borax or boric acid.

2. The powdered carpet cleaning composition according to claim 1 wherein the (a) alkali metal carbonate, (b) alkali metal bicarbonate, and (c) alkali metal sesquicarbonate are present in weight percentage ratios of (a):(b):(c) is 1:1–1.5:1– 1.5.

3. The powdered carpet cleaning composition according to claim 1 wherein the (a) alkali metal carbonate, (b) alkali metal bicarbonate, and (c) alkali metal sesquicarbonate are present in weight percentage ratios of (a):(b):(c) is 1:1–1.2:1–1.2.

4. The powdered carpet cleaning composition according to claim 1 wherein:

the inorganic salt system comprises (a) sodium carbonate, (b) sodium bicarbonate, and (c) sodium sesquicarbonate.

5. The powdered carpet cleaning composition according to claim 1 wherein the organic solvents are selected from the group consisting of alcohols, ketones and glycol ethers.

6. The powdered carpet cleaning composition according to claim 1 wherein the organic solvent is a glycol ether according to the structure $R_a$—O—$R_b$—OH, wherein:

$R_a$ is an alkoxy of 1 to 20 carbon atoms, or aryloxy of at least 6 carbon atoms, and $R_b$ is an ether condensate of propylene glycol and/or ethylene glycol having from one to ten glycol monomer units.

7. The powdered carpet cleaning composition according to claim 1 wherein the acid is an organic compound comprising one or more carboxylic acidic groups or salt thereof.

8. The powdered carpet cleaning composition according to claim 7 wherein the acid is selected from citric acid and ethyelenediaminetetraacetic acid.

9. The powdered carpet cleaning composition according to claim 1 wherein the zeolite is a type "X", type "Y", type "Z", or type "A" zeolite.

10. The powdered carpet cleaning composition according to claim 1 wherein the anionic surfactant is a $C_{12}$–$C_{20}$ alkylsulfonate.

11. The powdered carpet cleaning composition according to claim 1 wherein the anionic surfactant is selected from the group consisting of sulfonated primary or secondary fatty alcohols, ethoxylated sulfuric acid monoesters of aliphatic primary alcohols, ethoxylated sulfuric acid monoesters of secondary alcohols, ethoxylated sulfuric acid esters of alkylphenols, sulfated fatty acid alkanolamides and sulfated fatty acid monoglycefides.

12. The powdered carpet cleaning composition according to claim 1 wherein the composition is at a pH of at least about 8.0.

13. The powdered carpet cleaning composition according to claim 1 wherein the composition is at a pH of 8.0–10.0.

14. The powdered carpet cleaning composition according to claim 1 wherein the composition exhibits a bulk density of from 0.3–0.45 grams per cubic centimeter of volume.

15. The powdered carpet cleaning composition according to claim 1, wherein the composition further includes up to 10 percent by weight of one or more optional constituents selected from the group consisting of buffers, pH adjusting agents, fragrances, deodorizing agents, fillers, carriers, inorganic salts, optical brighteners, bleaching constituents, ultraviolet absorbants, antistatics, germicides, preservatives, fillers, talc, naturally occurring clays, synthetic clays, scattering promoters, spreading promoters, antisoiling inhibitors, resoiling inhibitors, and chelating agents.

16. The powdered carpet cleaning composition according to claim 1, wherein the anionic surfactant is a sulfosuccinic acid monoester having an alcohol portion or a sulfosuccinic acid diester having an alcohol portion, wherein the alcohol portion contains from 6 to 22 carbon atoms.

17. A process for cleaning a soiled fibrous textile substrate comprising the steps of:

(a) applying the powdered carpet cleaning composition of claim 1 to the soiled area of the textile substrate;

(b) interspersing the composition into the textile fibers; and (c) finally withdrawing the composition from the textile substrate.

18. The process according to claim 17 wherein the soiled fibrous textile substrate is a carpet.

19. A powdered carpet cleaning composition comprising:

A) from 25 to 35% by weight of a cellulose absorbent;

B) from 1 to 4% by weight of a zeolite or amorphous silica;

C) from 12 to 16% by weight of an inorganic salt system comprising (a) an alkali metal carbonate; (b) an alkali metal bicarbonate; and (c) an alkali metal sesquicarbonate, wherein the weight percentage ratios of (a):(b):(c) are 1:1–1.2:1–1.2;

D) from 5 to 7% by weight of an organic solvent;

E) from 0.01 to 3% by weight of an acid;

F) from 0.5 to 1.5% by weight of an anionic surfactant;

G) from 0.01 to 5% by weight of a nonionic surfactant;

H) from 42 to 48.5% by weight of water; and

I) from 0 to 5% by weight of optional constituents, with the proviso that the compositions do not comprise borax or boric acid, and are at a pH in the range from 9 to 10.

20. The powdered carpet cleaning composition according to claim 19, wherein the optional constituents are selected from the group consisting of buffers, pH adjusting agents, fragrances, deodorizing agents, fillers, carriers, inorganic salts, optical brighteners, bleaching constituents, ultraviolet absorbants, antistatics, germicides, preservatives, fillers, talc, naturally occurring clays, synthetic clays, scattering promoters, spreading promoters, antisoiling inhibitors, resoiling inhibitors, and chelating agents.

21. A process for cleaning a soiled fibrous textile substrate comprising the steps of:

(a) applying the powdered carpet cleaning composition of claim 19 to the soiled area of the textile substrate;

(b) interspersing the composition into the textile fibers; and (c) finally withdrawing the composition from the textile substrate.

22. A powdered carpet cleaning composition consisting essentially of:

A) from 25 to 35% by weight of a cellulose absorbent;

B) from 1 to 4% by weight of a zeolite or amorphous silica;

C) from 12 to 16% by weight of an inorganic salt system comprising (a) an alkali metal carbonate; (b) an alkali metal bicarbonate; and (c) an alkali metal sesquicarbonate, wherein the weight percentage ratios of (a):(b):(c) are 1:1–1.2:1–1.2;

D) from 5 to 7% by weight of an organic solvent;

E) from 0.01 to 3% by weight of an acid;

F) from 0.5 to 1.5% by weight of an anionic surfactant;

G) from 0.01 to 5% by weight of a nonionic surfactant;

H) from 42 to 48.5% by weight of water; and

I) from 0 to 5% by weight of optional constituents, with the proviso that the compositions do not comprise borax or boric acid, and are at a pH in the range from 9 to 10.

* * * * *